US006381974B1

(12) United States Patent
Hwang et al.

(10) Patent No.: US 6,381,974 B1
(45) Date of Patent: May 7, 2002

(54) COOLANT DISTRIBUTOR OF REFRIGERATING CYCLE FOR HEAT PUMP

(75) Inventors: Yoon Jei Hwang; Yang Kyu Kim, both of Seoul; Jong Han Park; Cheol Min Kim, both of Gwangmyung, all of (KR)

(73) Assignee: LG Electronics, Inc., Seoul (KR)

( * ) Notice: Subject to any disclaimer, the term of this patent is extended or adjusted under 35 U.S.C. 154(b) by 29 days.

(21) Appl. No.: 09/661,470

(22) Filed: Sep. 13, 2000

(30) Foreign Application Priority Data

Sep. 13, 1999 (KR) ..... 99-38993

(51) Int. Cl.[7] ..... F25B 5/00; F25B 39/02
(52) U.S. Cl. ..... 62/199; 62/525; 165/286
(58) Field of Search ..... 62/199, 117, 525; 165/286, 101, 296

(56) References Cited

U.S. PATENT DOCUMENTS 6,026,654 A * 2/2000 Park ..... 62/199
6,138,919 A * 10/2000 Cooper et al. ..... 62/199 X

* cited by examiner

*Primary Examiner*—William Wayner
(74) *Attorney, Agent, or Firm*—Birch, Stewart, Kolasch, and Birch, LLP

(57) ABSTRACT

A refrigerant distributor of a refrigerating cycle for a heat pump of the present invention comprising a compressor for compressing a refrigerant and discharging the refrigerant variably, a distributor for distributing the refrigerant passed through an expansion device expanding the refrigerant to a plurality of branching pipes and making the refrigerant flow to a evaporator including a plurality of blocks, a refrigerant flow controller installed on a certain branching pipe of the distributor for opening/closing the flow of the refrigerant to the branching pipes, and a by-pass pipe for making a certain amount of the refrigerant discharged variably from the compressor flow to the refrigerant flow controller by connecting the discharge side of the compressor and refrigerant flow controller so as to open/close the certain branching pipe of the distributor by the operation of the refrigerant flow controller in accordance with the discharge compressor of the refrigerant discharged variably from the compressor is capable of improving the capability of the evaporator and efficiency of the refrigerating cycle by preventing too much the rise of the evaporation temperature of the refrigerant by using the evaporation region of the external heat exchanger (performing the function of the evaporator in the heating operation) corresponding to the discharge quantity of the refrigerant discharged variably from the compressor.

5 Claims, 5 Drawing Sheets

COOLANT DISTRIBUTOR OF REFRIGERATING CYCLE FOR HEAT PUMP

BACKGROUND OF THE INVENTION

1. Field of the Invention

The present invention relates to a refrigerant distributor of a refrigerating cycle for a heat pump, in particular to the refrigerant distributor of the refrigerating cycle for the heat pump which is capable of distributing uniformly a refrigerant to a evaporator by using variably the capacity of the evaporator in accordance with discharge quantity of the refrigerant discharged variably from a variable capacity compressor by using discharge pressure of the refrigerant discharged variably from the variable capacity compressor comprised in the refrigerating cycle for the heat pump.

2. Description of the Conventional Art

In general, a refrigerating cycle comprises a compressor for compressing a working fluid so as to be high temperature and high pressure, a condenser for discharging an internal heat to the outside by converting the compressed high temperature and high pressure working fluid into liquid phase, an expansion device for lowering pressure of the liquid phase working fluid, and a evaporator for absorbing an external heat by vaporizing the liquid phase working fluid expanded in the expansion device into gas. The condenser and evaporator perform the heat exchange to the outside, accordingly they are also called as heat exchangers.

The refrigerating cycle apparatus is applied to a refrigerator, a showcase for preserving food freshly and an air conditioner for keeping a room temperature pleasantly in accordance with an outside temperature.

The air conditioner is classified into a general air conditioner having a cooling function and a heat pump air conditioner having both cooling and heatingfunctions.

As depicted in FIG.1, in the refrigerating cycle for the heat pump air conditioner, a 4-way valve 20 for switching a flow direction of the refrigerant is connected to a discharge side of a compressor 10 for compressing the refrigerant, an external heat exchanger 30 is connected to the side of the 4-way valve 20, an expansion device 40 is connected to the external heat exchanger 30, and an internal heat exchanger 50 is connected to the expansion device 40.

And, the internal heat exchanger 50 is connected to the 4-way valve 20 and the suction side of the compressor is connected to the 4-way valve 20.

The each part is connected each other by connection pipes 60.

A sirocco fan 70 for moving the air heat-exchanged in the internal heat exchanger 50 is installed on the side of the internal heat exchanger 50, and a axial-flow fan 80 for accelerating the heat exchange of the external heat exchanger 30 is installed on the side of the external heat exchanger 30.

The refrigerating cycle for the heat pump cools/heats a room by the internal heat exchanger 50 performing the function of the evaporator or condenser in accordance with the flow direction of the refrigerant discharged from the compressor 10 converting the flow direction by switching of the 4-way valve 20.

First, in the cooling operation, the flow direction of the 4-way valve is set in order to make the refrigerant discharged from the compressor 10 flow directly to the external heat exchanger 30, and at the same time get the internal heat exchanger 50 lead to the compressor 10. On the base of the structure, the refrigerant circulates through the compressor

10—4-way valve 20—external heat exchanger 30—expansion device 40—internal heat exchanger 50—4-way valve 20 —compressor 10 in accordance with the operation of the compressor 10.

In the circulation, the external heat exchanger 30 performs the function of the condenser, and the internal heat exchanger 50 performs the function of the evaporator. The cool air is generated by the internal heat exchanger 50 performing the function of the evaporator, and the cool air cools the room by ventilating the room by the operation of the sirocco fan 70. Also, the heat exchange of the external heat exchanger 30, namely, heat releasing is accelerated by the operation of the axial-flow fan 80.

In the heating operation, the flow direction of the 4-way valve is set in order to make the coolant discharged from the compressor 10 flow directly to the internal heat exchanger 50, and at the same time get the external heat exchanger 50 lead to the compressor 50. On the base of the structure, the coolant circulates is by passing through the compressor 10—4-way valve 20—internal heat exchanger 50—expansion device 40—external heat exchanger 30—4-way valve 20 compressor in accordance with the operation of the compressor 10.

In the circulation, the internal heat exchanger 50 performs the function of the condenser, and the external heat exchanger 30 performs the function of the evaporator. The warm air is generated by the internal heat exchanger 50 performing the function of the condenser, and the warm air heats the room by ventilating the room by the operation of the sirocco fan 70. Also, the heat exchange of the external heat exchanger 30, namely, the heat releasing is accelerated by the operation of the axial-flow fan 80.

In the heating operation of the refrigerating cycle for the heat pump,-when the liquid phase refrigerant passed through the internal heat exchanger 50 flows to the external heat exchanger 30 after passing through the expansion device 40, herein when the refrigerant passed through the expansion device 40 directly flows to the external heat exchanger 30, the evaporation is not sufficiently performed in the external heat exchanger 30. Accordingly, as depicted in FIG.2, a distributor 90 for providing after distributing the coolant passed through the expansion device 40 to the external heat exchanger 30 is installed between the expansion device 40 and external heat exchanger 30 in order to accelerate the evaporation in the external heat exchanger 30.

As depicted in FIG. 3, the conventional structure of the distributor for distributing the refrigerant in the refrigerating cycle of the heat pump comprises a body unit 91 having a hollow cone shape and a plurality of branching pipes 92 connected to a flat surface of the body unit 91. The top point of the body unit 91 is combined to the connection pipes 60, and the plurality of the branching pipes 92 are connected to the external heat exchanger 30.

The external heat exchanger 30 comprises a plurality of blocks, and the each block is connected to the each branching pipe of the distributor 90.

In the operation of the conventional distributor 90, the refrigerant in the state of different phase passed through the expansion device 40 flows to the body unit 91 of the distributor 90 through the connection pipe 6D, is divided by the plurality of the branching pipes 92, and flows to the each block of the external heat exchanger 30. The refrigerant flown into the each block of the external heat exchanger 30 evaporates while passing through the each block, the evaporated refrigerant is gathered through the one flow channel, is passed through the 4-way valve, and is sucked into the compressor 10.

In the refrigerating cycle for the heat pump, the operating speed of the compressor 10 is variable in accordance with the load on the internal heat exchanger 50, namely, the temperature of the room. When the load pressed on the internal heat exchanger 50 is small and the compressor 10 operates in the low speed, the discharge quantity of the refrigerant discharged from the compressor 10 is partly small, and the partly small quantity of the refrigerant circulates in the evaporator circuits. In addition, when the load pressed on the internal heat exchanger 50 is big and the compressor operates in the high speed, the discharge quantity of the refrigerant is relatively large, and the large quantity of the refrigerant circulates in the evaporator circuits.

However, in the conventional refrigerant distributing structure of the refrigerating cycle for the heat pump, in spite of variable flow quantity of the refrigerant circulating the cycle in accordance with the variable operating speed of the compressor 10, namely, the capacity of the external heat exchanger 30 where is the evaporation is performed in the heating operation is used regularly, accordingly the Capacity of the external heat exchanger 30 is not used properly.

In other words, when the partly small quantity of the refrigerant circulates the evaporator circuits due to the low speed operation of the compressor 10, the partly small quantity of the refrigerant flows to the external heat exchanger 30 through the distributor 90 and evaporates, the evaporation of the refrigerant is performed rapidly, the temperature of the overall external heat exchanger 30 can not be kept as the proper evaporation temperature or the uniform evaporation temperature, accordingly the efficiency of the cycle lowers due to the efficiency decline of the external heat exchanger 30. In other words, when the circumference temperature of the external heat exchanger 30 is regular, the evaporation temperature of the refrigerant becomes higher in the external heat exchanger 30, the evaporation efficiency of the external heat exchanger 30 lowers

SUMMARY OF THE INVENTION

The object of the present invention is to provide a refrigerant distributor of a refrigerating cycle for a heat pump which is capable of distributing uniformly a refrigerant to a evaporator by using variably capacity of the evaporator in accordance with quantity of refrigerant discharge discharged variably from a compressor by using discharge pressure of the refrigerant discharged variably from the compressor comprised in the refrigerating cycle for the heat pump.

The refrigerant distributor of the refrigerating cycle for the heat pump of the present invention comprises a compressor for compressing a refrigerant and discharging the refrigerant variably, a distributor for distributing the refrigerant passed through an expansion device expanding the refrigerant to a plurality of branching pipes and making the refrigerant flow to a evaporator including a plurality of blocks, a refrigerant flow controller installed on a certain branching pipe of the distributor for opening/closing the flow of the refrigerant to the branching pipes, and a by-pass pipe for making a certain amount of the refrigerant discharged variably from the compressor flow to the refrigerant flow controller by connecting the discharge side of the compressor and refrigerant flow controller so as to open/close the certain branching pipe of the distributor by the operation of the refrigerant flow controller in accordance with the discharge pressure of the refrigerant discharged variably from the compressor.

DETAILED DESCRIPTION OF THE PREFERRED EMBODIMENT

Hereinafter, the embodiment of a refrigerant of a refrigerating cycle for a heat pump of the present invention will now be described in detail with reference to accompanying drawings.

The present invention may be embodied in many ways; hereinafter the most advisable embodiment will now be described.

Hereinafter, the construction, which is same with the conventional construction, Hill be abridged.

Figure 1:
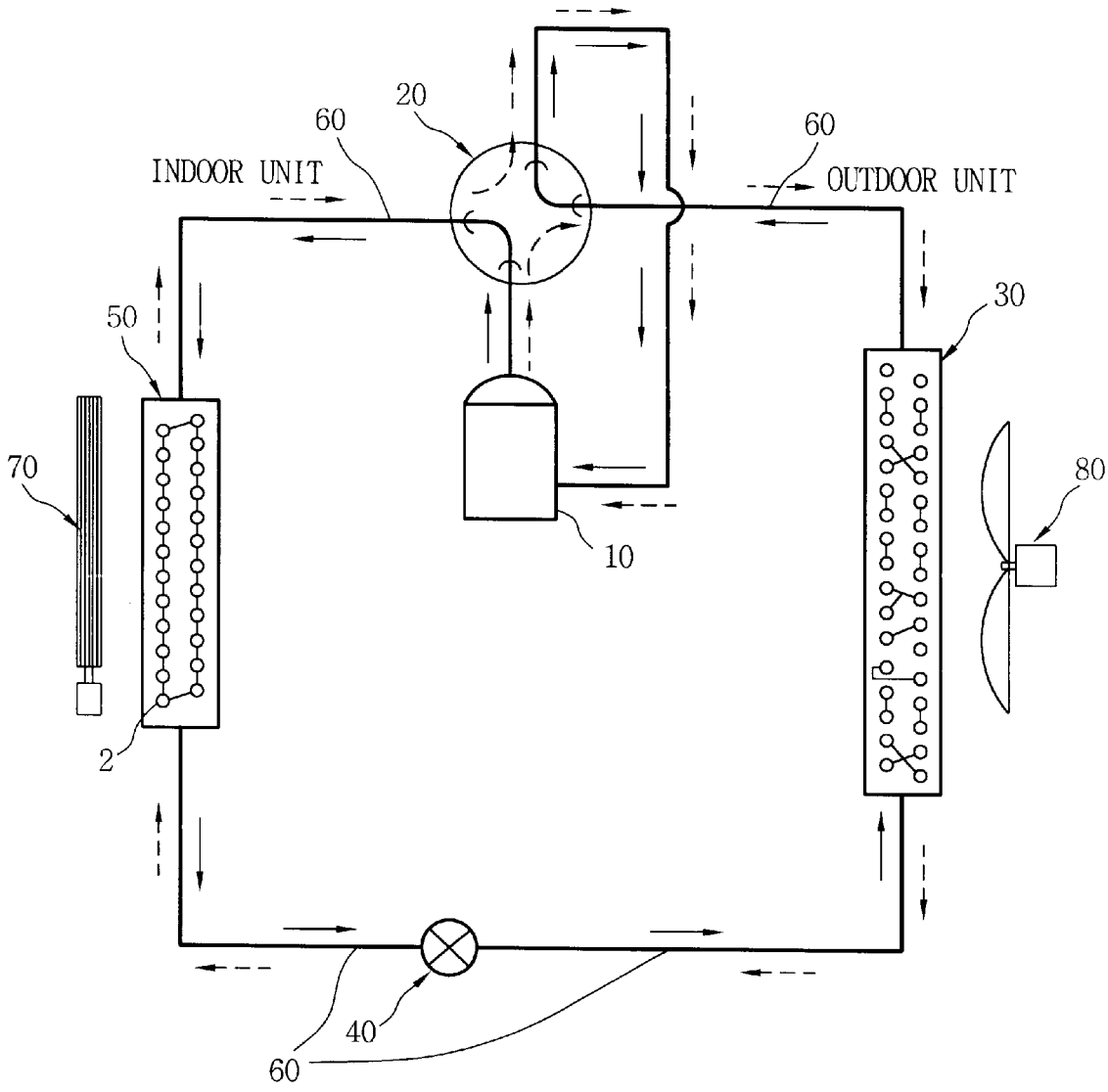
FIG. 1 CONVENTIONAL ART
FIG. 1 is a pipe drawing illustrating a general refrigerating cycle for a heat pump.
Figure 2:
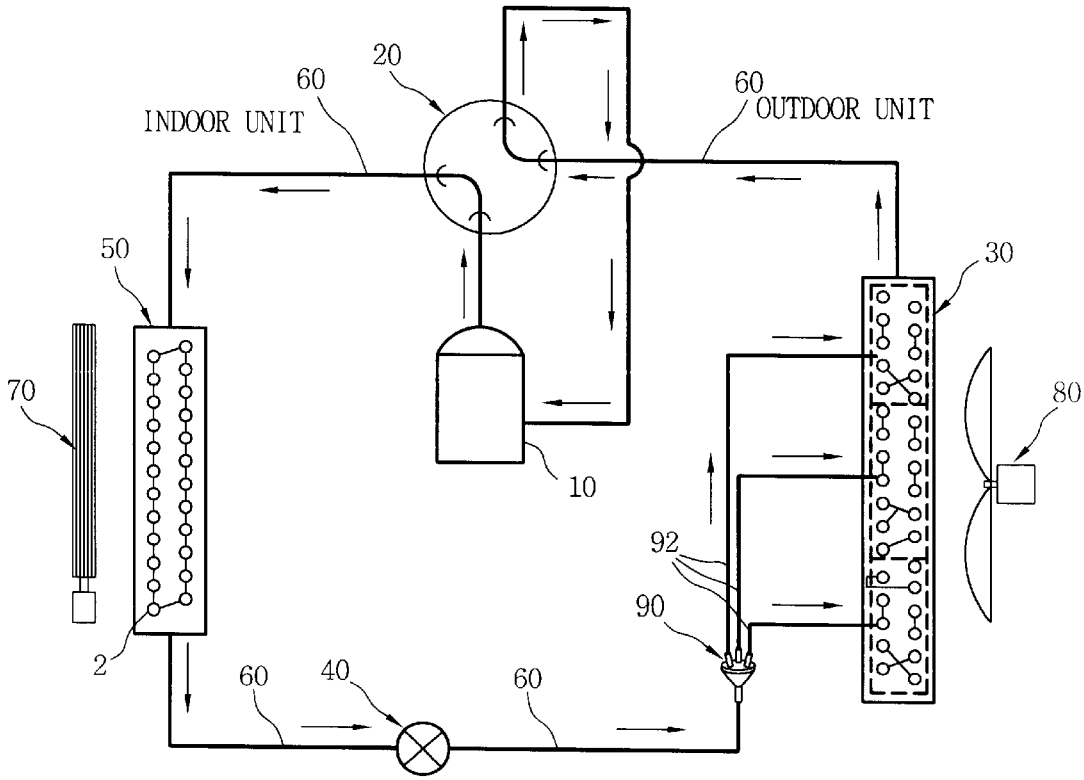
FIG. 2 CONVENTIONAL ART
FIG. 2 is a pipe drawing illustrating the conventional refrigerating cycle for the heat pump comprising the distributor.
Figure 3:
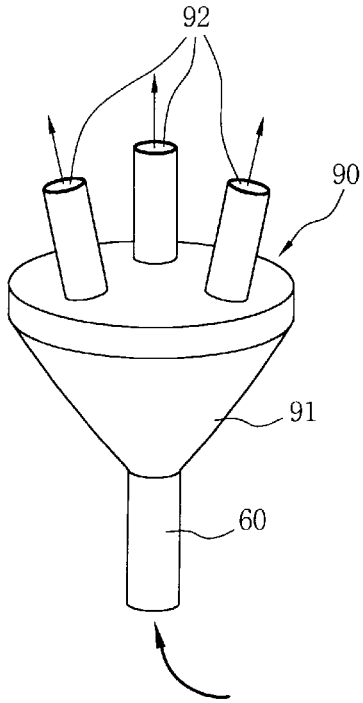
FIG. 3 CONVENTIONAL ART
FIG. 3 is a perspective view magnifying-illustrating the distributor.
Figure 4:
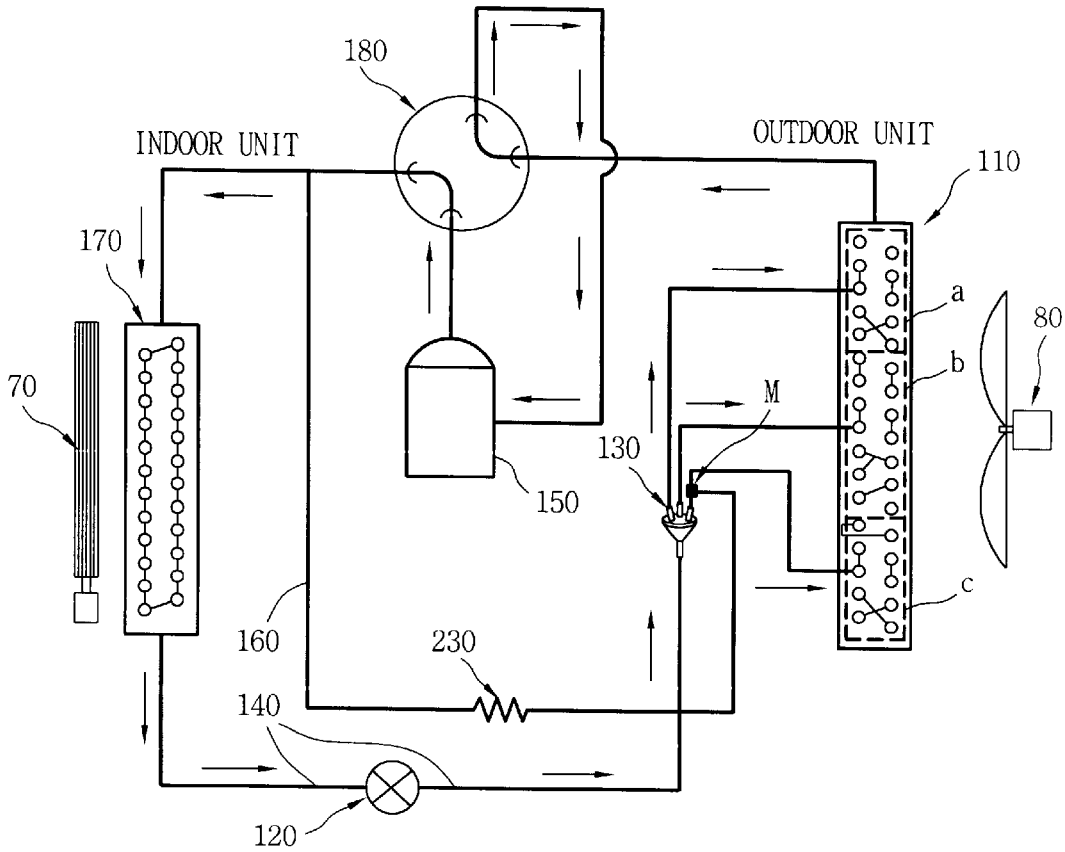
FIG. 4 is a pipe drawing illustrating the refrigerating cycle for the heat pump comprising a refrigerant distributor of the present invention.

As depicted in FIG. 4, in the refrigerant distributor of the refrigerating cycle to for the heat pump of the present invention having both cooling function and heating function, a distributor 130 is installed between an external heat exchanger 110 and an expansion device 120 expanding the refrigerant, and a refrigerant flow controller M is installed on the side of the distributor 130. The each part constructing the freezing cycle for the heat pump is connected by connection pipes 140.

The discharging side of the compressor 150 is connected to the coolant flow controller M by the by-pass pipe 160 in order to make the part of the refrigerant discharged from the compressor 150 compressing the refrigerant in the heating operation of the refrigerating cycle for the heat pump flow into the refrigerant flow controller M.

The connection position of the by-pass pipe 160 will now be described in detail, the one side of the by-pass pipe 160 is connected to a certain portion of a guiding pipe 140 placed between compressor 150 for compressing refrigerant and an internal heat exchanger 170, and the other side of the by-pass pipe 160 is connected to the refrigerant flow controller M in order to make the refrigerant discharged from the compressor 150 flow to the internal heat exchanger 170 in the heating operation of the refrigerating cycle for the heat pump.

A capillary for depression 230 for expansion of the refrigerant passing through the by-pass pipe 160 is installed at the certain portion of the by-pass pipe 160.

In addition, an electric expansion valve for expansion of the refrigerant passing through the by-pass pipe can be installed at the by-pass pipe 160 instead of the capillary for depression 230.

The external heat exchanger 110 comprises the plurality of the blocks, and performs the function of the evaporator in the heating operating of the freezing cycle for the heat pump.

Figure 5:
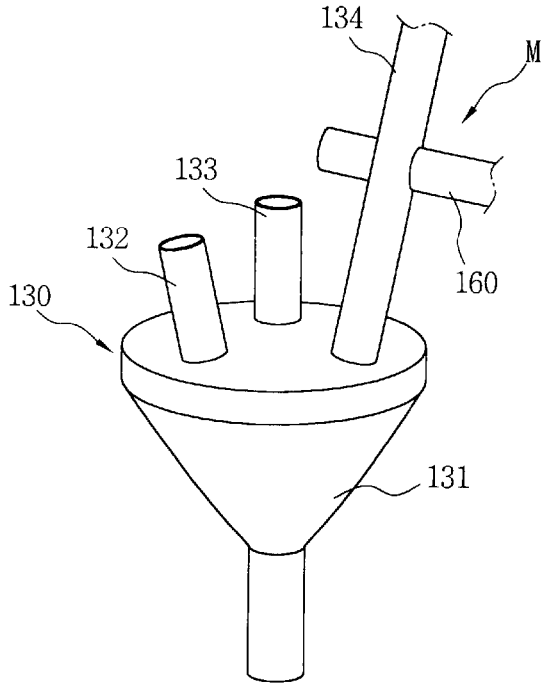
FIG. 5 is a perspective view illustrating a distributor and a refrigerant flow controller comprised in the refrigerant distributor of the refrigerating cycle for the heat pump of the present invention.

As depicted in FIG. 5, the distributor 130 comprises a body unit 131 having a hollow cone shape and a plurality of branching pipes 132, 133, 134 connected to the flat surface of the body unit 131. A connection pipe 140 connected to the expansion device 120 is combined to the knob portion of the body unit 131, and the plurality of the branching pipes 132, 133, 134 are connected to the external heat exchanger 110. The branching pipes 132, 133, 134 of the distributor are separately connected to the blocks of the external heat exchanger 110. The external heat exchanger 110 comprises three blocks a, b, c in order to be corresponded to the branching pipes 132, 133, 134 of the distributor.

Figure 6:
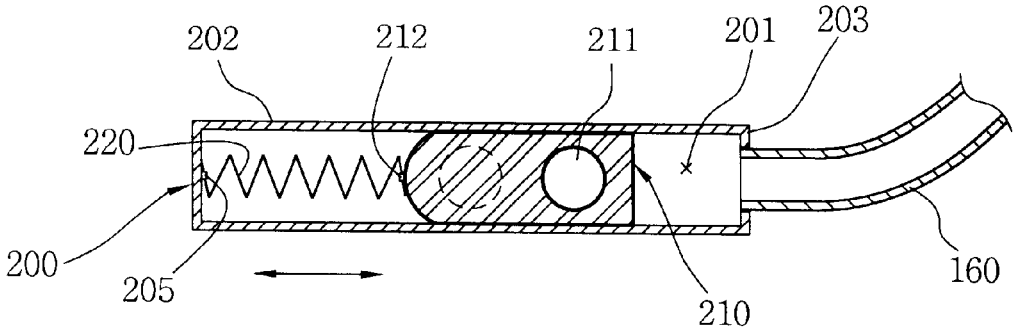
FIG. 6 is a cross sectional view illustrating the refrigerant flow controller comprised in the refrigerant distributor of the refrigerating cycle for the heat pump of the present invention.
Figure 7:
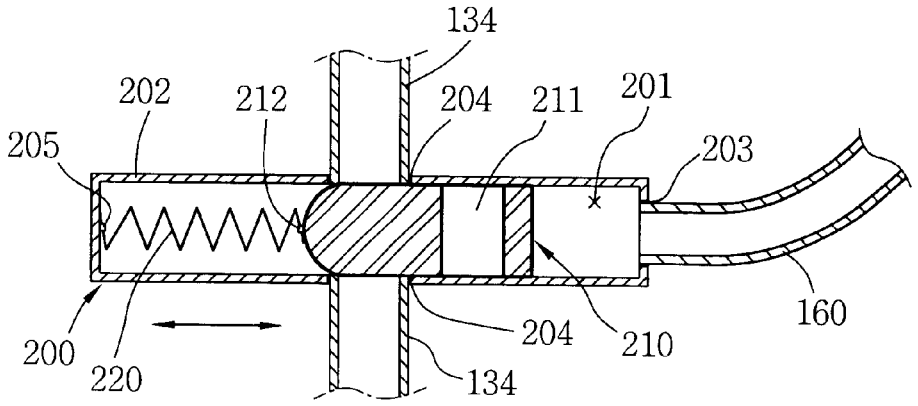
FIG. 7 is a vertical sectional view illustrating the refrigerant flow controller comprised in the refrigerant distributor of the refrigerating cycle for the heat pump of the present invention.

The refrigerant flow controller M is installed at a certain branching pipe 134 among the plurality of the branching pipes 132, 133, 134 of the distributor. As depicted in FIG. 6 and FIG. 7, the refrigerant flow controller M comprises a cylinder 200 having an internal space 201 the side of the cylinder 200 is combined to a certain branching pipe of the distributor 130 so as to be connected to the internal space 201 and the other side of the cylinder 200 is combined to the by-pass pipe 160 so as to be connected to the internal space 201, a slider 210 for opening/closing a certain branching pipe of the distributor 130 in accordance with the pressure of the refrigerant flowing to the internal space 201 of the cylinder 200 through the by-pass pipe 160, and a spring combined between the inner wall of the internal space 201 of the cylinder 200 and the slider 210 in order to give elasticity to the slider 210.

A combination hole 203 is formed on the one side of the cylinder body unit 202 having the internal space 201 so as to be connected with the internal space 201, and a connection hole 204 is formed on the cylinder body unit 202 so as to penetrate the internal space 201. The internal space 201 is formed so as to have a certain length and have a round shape section. The connection holes 204 are formed on the same axial line placed vertically to the cylinder body unit 202 so as to be placed on the middle portion of the internal space 201. The combination hole 203 is formed on the cylinder body unit 202 so as to be placed on the length directional end portion of the internal space 201, and is combined to the one side of the by-pass pipe 160. A spring bridging portion 205 is formed on the inner wall of the internal space 201 placed opposite to the combination hole 203. The branching pipe 134 of the distributor is combined to the connection hole 204 of the cylinder body unit. Herein, the branching pipe 134 is divided into two parts, the two parts are separately connected to the connection hole 204 of the cylinder body unit, and the center lines of the branching pipe 134 and internal space 201 are formed so as to be vertical each other.

The slider 210 is formed so as to have variable cross section corresponding to the section shape of the internal space 201 of the cylinder and have the length shorter than the length of the internal space 201, and a through hole 211 is formed in the slider 210 corresponding to the size of the cylinder connection hole 204. The spring bridging portion 212 for bridging the spring is formed on the side of the slider 210.

The spring 220 is a coil spring. The spring 220 is placed in the cylinder internal space 201, the one side of the spring 220 is combined to the spring bridging portion 205 of the cylinder 200, and the other side of the spring 220 is combined to the spring bridging unit 212 of the slider 210. When the spring 220 contracts, the through hole 211 of the slider coincides to the connection hole 204 of the cylinder, when the spring 220 expands, the slider 210 blocks the connection hole 204 of the cylinder.

A non-explanation reference numeral 70 is a sirocco fan, and a non-explanation reference numeral 80 is an axial-flow fan 80.

Hereinafter, the operation and advantages of the refrigerant distributor of the refrigerating cycle for the heat pump of the present invention will now be described.

As described above, the refrigerating cycle for the heat pump can be selected as the cooling operation and heating operation as occasion demands.

The operation and advantages of the refrigerating cycle for the heat pump of the present invention will now be described with an example of the heating operation.

In the heating operation of the refrigerating cycle for the heat pump, the flow direction of the 4-way valve 180 is switched in order to make the refrigerant discharged from the compressor 150 flow directly to the internal heat exchanger 170, and at the same time get the external heat exchanger 110 lead to the compressor 150. On the base of the structure, the refrigerant circulates through the compressor 150—4-way valve 180—internal heat exchanger 170—expansion device 120—distributor 130—external heat exchanger 110—4-way valve 180—compressor 150 in accordance with the operation of the compressor 10.

In the circulation, the internal heat exchanger 170 performs the function of the condenser, and the external heat exchanger 110 performs the function of the evaporator. In other words, the heat is discharged to the outside by compressing the refrigerant in the internal heat exchanger 170, the external heat is absorbed by vaporizing the refrigerant in the external heat exchanger 110, accordingly the cooling air is formed around circumference of the external heat exchanger 110.

In the operation of the refrigerating cycle for the heat pump, the operating speed of the compressor 150 is variable in accordance with the load on the internal heat exchanger 170, namely, the temperature of the room where the internal heat exchanger 170 is installed. In more detail, when the room temperature Is low, the compressor 150 operates in the high speed, the discharge quantity of the refrigerant increases, accordingly the heat capacity generated in the internal heat exchanger 170 increases by the increased refrigerant circulating the cycle. When the room temperature is relatively high, the compressor 150 operates in the low speed, the discharge quantity of the refrigerant discharged from the compressor 150 decreases, accordingly the heat capacity generated in the internal heat exchanger 170 decreases by the decreased refrigerant circulating the cycle.

Figure 8:
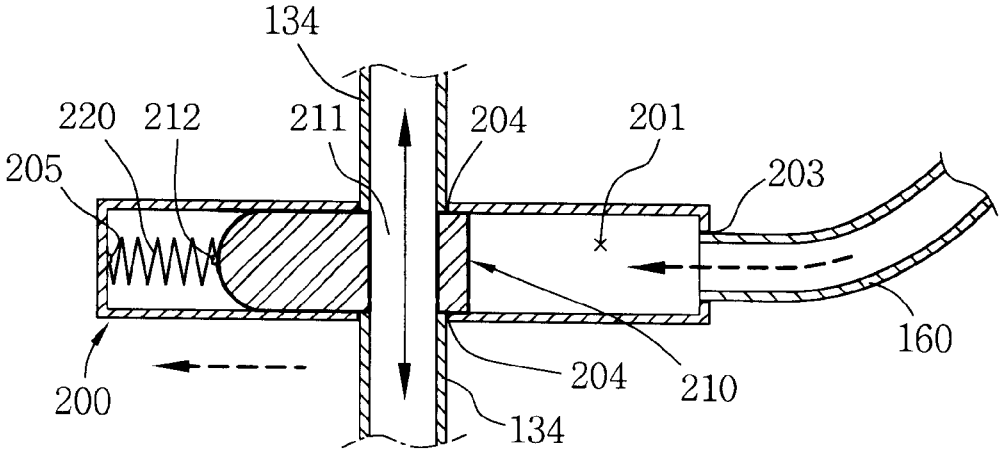
FIG. 8 is a vertical sectional view illustrating the Operation State (opening) of the refrigerant distributor of the refrigerating cycle for the heat pump of the present invention.

Meanwhile, when the refrigerant mass discharged from the compressor 150 is large in the heating operation, a certain amount of the refrigerant discharged from the compressor 150 flows into the internal space 201 of the cylinder constructing the refrigerant flow controller M through the by-pass pipe 160 as the high pressure state. When the high pressure refrigerant flows into the internal space of the cylinder, as depicted in FIG.8, the slider 210 inserted into the internal space 201 of the cylinder is compressed, the spring 220 supporting the slider 210 is extracted, and the slider 210 is pushed to the spring 220. Because the slider 210 is pushed to the spring 220, the through hole 211 of the slider is lead to the internal flow channel of the branching pipe 134 combined to the connection hole of the cylinder, the branching pipe 134 of the distributor is in the open state, and the open state of the branching pipe 134 is continued by the discharging pressure of the coolant discharged from the compressor 150. At the same time, the large quantity of the refrigerant discharged from the compressor 150 flows into the distributor 130 by passing through the 4-way valve 180, internal heat exchanger 170 and expansion device 120, and the refrigerant flown into the distributor 130 flows into the external heat exchanger 110 through the plurality of the branching pipes 132, 133, 134 of the distributor 130. Herein, the refrigerant flows into the each block a, b, c of the external heat exchanger 110 through the all branching pipes 132, 133, 134 including the Branching pipe 134 where the refrigerant flow controller M is installed. The refrigerant flown into the each block a, b, c of the external heat exchanger 110 evaporates in the each block a, b, c, the evaporated evaporator is gathered in the one flow channel, and the refrigerant is sucked into the compressor 150 through the 4-way valve 180.

As alike, when the large amount of the refrigerant is discharged from the compressor 150, the refrigerant is evenly divided through the all branching pipes 132, 133, 134 of the distributor and flows into the all blocks a, b, c of the external heat exchanger 110, and the refrigerant is evaporated through the all blocks of the external heat exchanger 110, namely, the overall external heat exchanger When, the discharge quantity of the refrigerant discharged from the compressor 150 is small, the part of the refrigerant discharged from the compressor 150 weakly pushes the slider 210 placed in the internal space of the cylinder through the by-pass pipe 160.

Figure 9:
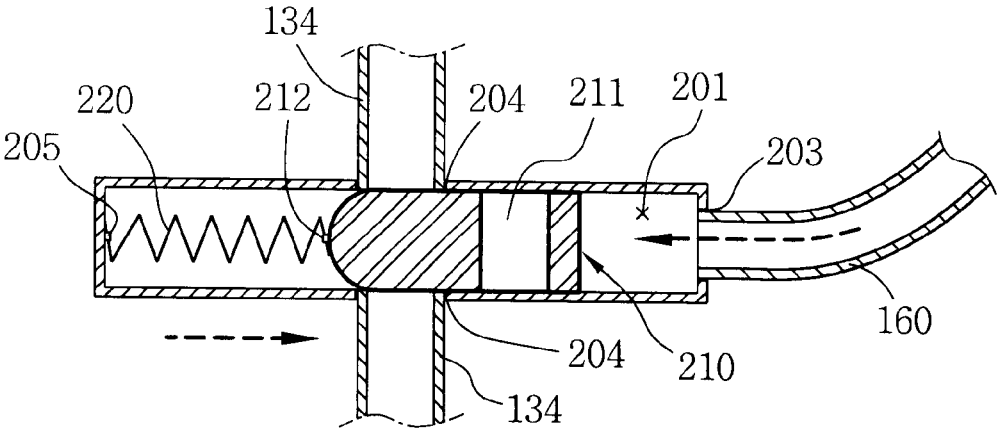
FIG. 9 is a vertical sectional view illustrating the Operation State (closing) of the refrigerant of the refrigerating heat pump of the present invention.

As depicted in FIG. 9, as the pressure pushing the slider 210 weakens, the slider 210 is moved back to the initial position by the restoring force of the spring 220 supporting the slider 210, the through hole 211 of the slider is crossed to the internal flow channel of the branching pipe 134 combined to the connection hole 204 of he cylinder, accordingly the branching pipe 134 of the distributor 130 is closed by the slider 210. At the same time, the small amount of the refrigerant discharged from the compressor 150 flows into the distributor 134 through the 4-way valve 180, internal hat exchanger 170, expansion device 120, the refrigerant flown into the distributor 130 is divided through the branching pipes 132, 133 with the exception of the branching pipe 134 and flows into the external heat exchanger 110. In other words, the refrigerant flows into the blocks a, b of the external heat exchanger 110 connected to the branching pipe 132, 133 with the exception of the branching pipe 134 installed the refrigerant flow controller M, it is prevented the refrigerant does not flow into the block c of the external heat exchanger 110 connected to the branching pipe 134. The refrigerant the each block a, b of the external heat exchanger 110 is separately evaporated in the blocks a, b, the evaporated refrigerant is gathered in the one flow channel and is sucked into the compressor 150 through the 4-way valve.

In other words, when the small quantity of the coolant is discharged from the compressor 150, the refrigerant flows into the external heat exchanger 110 through the branching pipes 132, 133 with the exception of the branching pipe 134 installed the refrigerant flow controller M and is evaporated, accordingly the part of the overall external heat exchanger 110 is used.

The distributing quantity of the refrigerant flowing to the external heat exchanger 110 is adjusted in order to use the evaporating area of the external heat exchanger 110 (which performs the function of the evaporator in the heating operation) corresponding to the variable discharge quantity of the coolant discharged from the compressor 150 by changing the operation of the cycle, namely, the operation speed of the compressor 150 in accordance with the load pressed on the refrigerating cycle for the heat pump, changing the discharge quantity of the refrigerant discharged from the compressor 150, and using the discharge pressure of the refrigerant in accordance with the variable discharge quantity of the refrigerant of the compressor 150, A capillary for depression 230 or an electric expansion valve for depression installed on the by-pass pipe 160 depresses the pressure compressed on the refrigerant flow controller M by depressing the pressure of the refrigerant discharged from the compressor 150 and flown to the by-pass pipe 160. Accordingly, the elastic modulus of the spring comprised in the refrigerant flow controller M lowers.

The refrigerant distributor of the refrigerating cycle for the heat pump of the present invention is capable of improving the efficiency of the refrigerating cycle by heightening the efficiency of the evaporator by using the discharge pressure of the refrigerant discharged variably from the compressor comprised in the refrigerating cycle for the heat pump in accordance with the load, distributing the refrigerant to the external heat exchanger in order to use the area of the external heat exchanger corresponding to the discharge quantity of the refrigerant discharged variably from the compressor and using the external heat exchange efficiently, and preventing the rise of the evaporating temperature of the refrigerant.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the meets and bounds of the claims, or equivalence of such meets and bounds are therefore intended to be embraced by the appended claims.

What is claimed is:

1. A refrigerant distributor of a refrigerating cycle for a heat pump, comprising:

a compressor for compressing a refrigerant and discharging the refrigerant variably;

a distributor for distributing the refrigerant passed through an expansion device expanding the refrigerant to a plurality of branching pipes and making the refrigerant flow to a evaporator including a plurality of blocks;

a refrigerant flow controller installed on a certain branching pipe of the distributor for opening/closing the flow of the refrigerant to the branching pipes; and a by-pass pipe for making a certain amount of the refrigerant discharged variably from the compressor flow to the refrigerant flow controller by connecting the discharge side of the compressor and refrigerant flow controller so as to open/close the certain branching pipe of the distributor by the operation of the refrigerant flow controller in accordance with the discharge compressor of the refrigerant discharged variably from the compressor.

2. The apparatus according to claim 1, wherein the refrigerant distributor of the refrigerating cycle for the heat pump is characterized by comprising a capillary for depression installed on the by-pass pipe for depressing the pressure of the refrigerant flowing into the by-pass pipe.

3. The apparatus according to claim 1, wherein the refrigerant distributor of the refrigerating cycle for the heat pump is characterized by comprising an electric expansion valve for depression installed on the by-pass pipe for depressing the pressure of the coolant flowing the by-pass pipe.

4. The apparatus according to claim 1, wherein the refrigerant flow controller comprising:

a cylinder having an internal space the side of the cylinder is combined to a certain branching pipe of the distributor so as to be connected to the internal space and the other side of the cylinder is combined to the by-pass pipe so as to be connected to the internal space;

a slider for opening/closing a certain branching pipe of the distributor in accordance with the pressure of the refrigerant flowing to the internal space of the cylinder through the by-pass pipe; and a spring combined between the inner wall of the internal space of the cylinder and the slider in order to give elasticity to the slider.

5. The apparatus according to claim 4, wherein the refrigerant distributor of the refrigerating cycle for the heat pump is characterized by combining the cylinder to a certain branching pipe of the distributor in order to get the direction of the certain branching pipe of the distributor and axial line of the internal space of the cylinder crossed vertically.

* * * * *